US007057529B2

(12) United States Patent
Bourgault

(10) Patent No.: US 7,057,529 B2
(45) Date of Patent: Jun. 6, 2006

(54) LED TRAFFIC SIGNAL LOAD SWITCH

(75) Inventor: Jean Simon Bourgault, Lachine (CA)

(73) Assignee: GELcore LLC, Valley View, OH (US)

( * ) Notice: Subject to any disclaimer, the term of this patent is extended or adjusted under 35 U.S.C. 154(b) by 68 days.

(21) Appl. No.: 10/444,706

(22) Filed: May 23, 2003

(65) Prior Publication Data

US 2004/0032339 A1 Feb. 19, 2004

Related U.S. Application Data

(60) Provisional application No. 60/383,262, filed on May 24, 2002.

(51) Int. Cl.
*G08G 1/095* (2006.01)

(52) U.S. Cl. ..... 340/907; 340/910; 340/916; 340/917; 340/931; 340/641; 200/19.37

(58) Field of Classification Search ..... 340/636.16, 340/635, 907, 910, 916, 917, 931, 941, 815.4, 340/815.45; 200/19.37; 315/247, 291, 307
See application file for complete search history.

(56) References Cited

U.S. PATENT DOCUMENTS 4,408,180 A * 10/1983 Metz ..... 340/909
5,327,123 A * 7/1994 Heimann et al. ..... 340/916
5,612,596 A * 3/1997 Wiese ..... 315/291
6,150,771 A * 11/2000 Perry ..... 315/291
6,153,985 A * 11/2000 Grossman ..... 315/291

* cited by examiner

*Primary Examiner*—Hung Nguyen
(74) *Attorney, Agent, or Firm*—Fay, Sharpe, Fagan, Minnich McKee, LLP

(57) ABSTRACT

An LED traffic signal having a single switching power supply placed inside the load switch to supply power to each of the aspect signals. The traffic signal has several aspects, such as red, yellow and green. The load switch comprises a switching power supply to supply power to the signals, an output selection circuit to select the desired aspect, and a conflict monitor interface circuit to mimic an incandescent circuit.

18 Claims, 5 Drawing Sheets

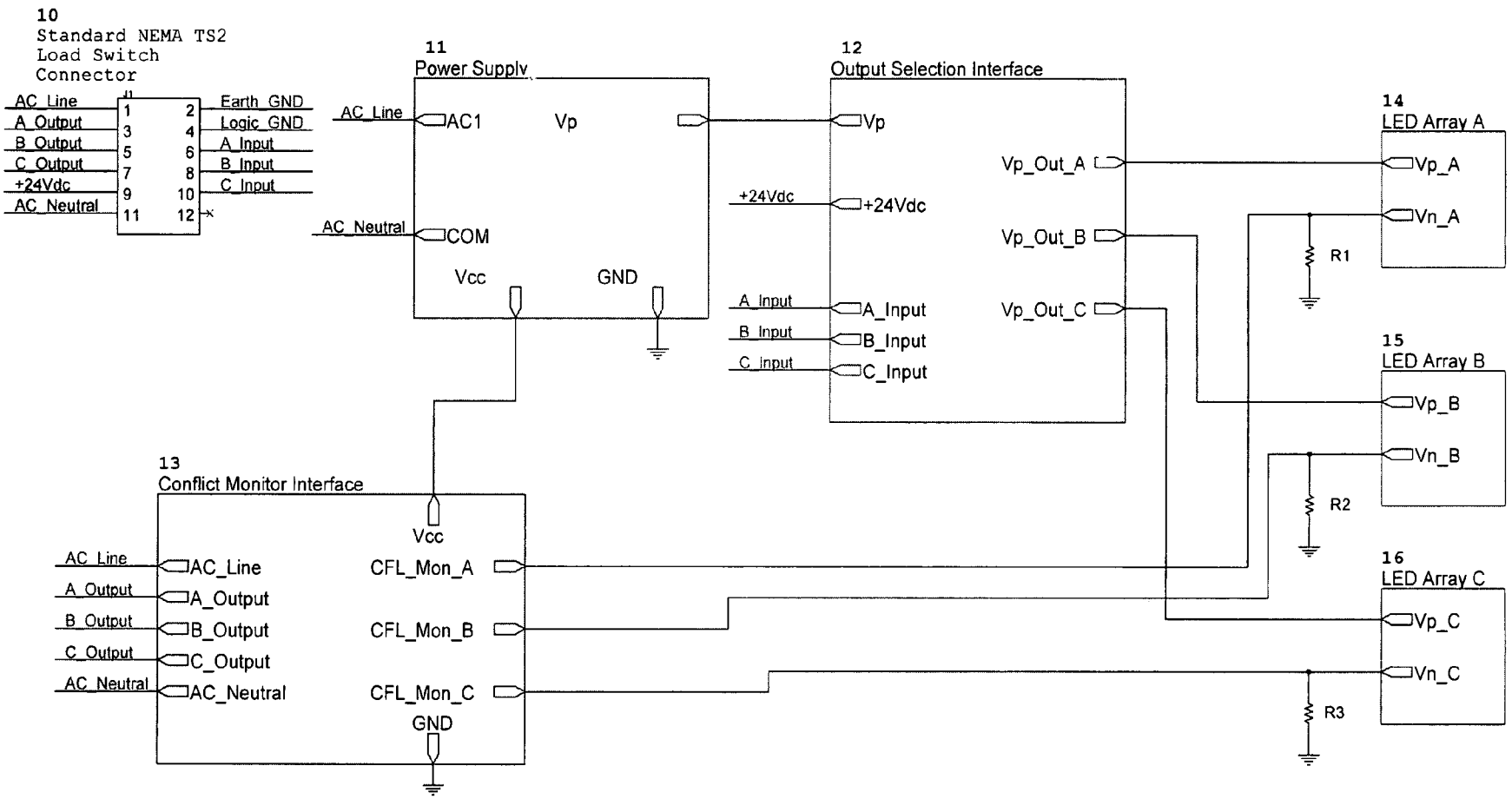
10
Standard NEMA TS2
Load Switch
Connector
J1
AC_Line
A_Output
B_Output
C_Output
+24Vdc
AC_Neutral
Earth_GND
Logic_GND
A_Input
B_Input
C_Input
11
Power Supply
AC1
COM
Vp
Vcc
GND
AC_Line
AC_Neutral
12
Output Selection Interface
Vp
+24Vdc
A_Input
B_Input
C_Input
Vp_Out_A
Vp_Out_B
Vp_Out_C
+24Vdc
A_Input
B_Input
C_Input
13
Conflict Monitor Interface
Vcc
CFL_Mon_A
CFL_Mon_B
CFL_Mon_C
GND
AC_Line
A_Output
B_Output
C_Output
AC_Neutral
AC_Line
A_Output
B_Output
C_Output
AC_Neutral
14
LED Array A
Vp_A
Vn_A
15
LED Array B
Vp_B
Vn_B
16
LED Array C
Vp_C
Vn_C
R1
R2
R3

LED TRAFFIC SIGNAL LOAD SWITCH

This application claims the benefit of U.S. Provisional Application No. 60/383262 filed May 24, 2002.

BACKGROUND OF THE INVENTION

1. Field of the Invention

The present invention relates to traffic signals and the electrical power control circuitry driving them. In particular, this invention deals with light emitting diode (LED) traffic signals controlled via standardized NEMA TS2 load switches. More specifically, this invention introduces a system where a single power supply placed inside the load switch replaces the three power supplies of three conventional LED traffic signals connected to the load switch.

2. Description of Related Art

LED traffic signals are gaining in popularity, replacing the prior designs using incandescent bulbs. Driven by the stable current and voltage levels produced by switching power supplies, LED traffic signals consume relatively low amounts of power and have extremely long lifetimes compared to standard incandescent light bulbs.

Previously, LED traffic lights have been used as a direct retrofit for previously existing incandescent light bulbs. Because most signal installations normally have at least three traffic signals per load switch (red, yellow and green signals), at least three LED power supplies are required. Considering that there is only one traffic signal activated at a time, it is possible, via the present invention, to use only a single power supply per load switch, resulting in significant manufacturing and operating power consumption cost savings.

SUMMARY OF THE INVENTION

The present invention is composed of two main parts: the load switch and the traffic signals. The load switch has a standard NEMA TS2 type connector, a switching power supply, an output selection circuit and a conflict monitor interface circuit. The power supply turns on as soon as the load switch is plugged into the intersection control cabinet. The output selection circuit is activated by the intersection controller whenever it wants to switch a traffic signal on or off. The conflict monitor interface circuit monitors the current through the traffic signal to relay the desired "incandescent bulb" state to the load switch outputs.

BRIEF DESCRIPTION OF THE DRAWINGS

In order to fully describe the invention, a specific embodiment is provided in schematic form.

FIG. 1 is a block diagram of the invention.

DETAILED DESCRIPTION

Figure 2:
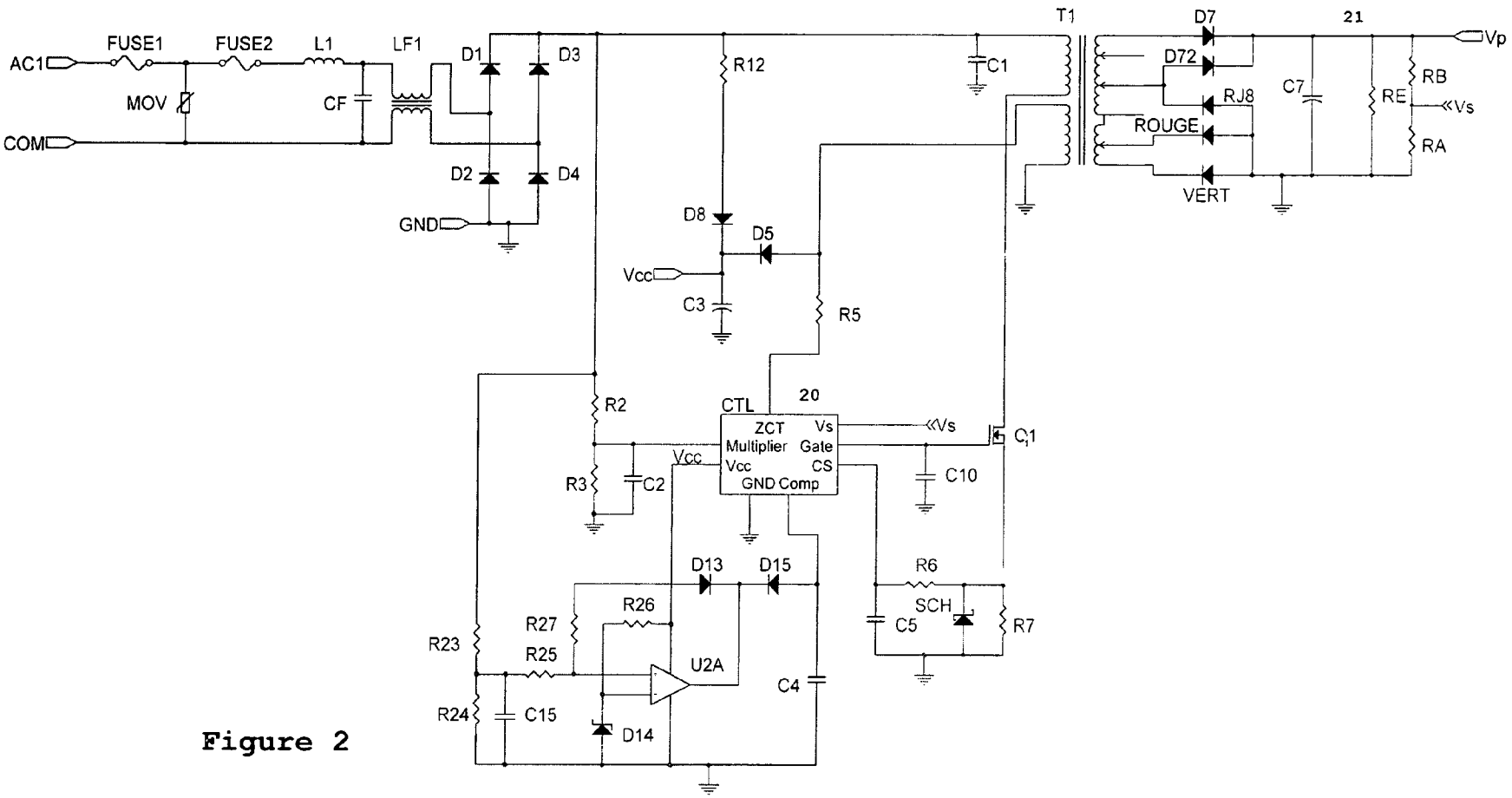
FIG. 2 is an electrical circuit diagram of the power supply.

FIG. 1 shows one possible embodiment of the invention in block form. The power supply 11 is directly connected to the mains line. Therefore, as soon as the load switch 10 is connected, the power supply 11 will be on and ready for use.

The output Vp of the power supply 11, is connected to the output selection interface 12. The output selection interface 12 is controlled by the intersection controller (existing) through load switch 10. Whenever the intersection controller asks that a traffic signal be activated, the output selection interface 12 applies the power supply 11 output Vp to the selected traffic signal 14, 15 or 16. More than one traffic signal may be hooked up to a single output, for example in the case of opposing intersection signals. Because the number of signals driven by the same switch is unlimited, the single power supply per switch is sized for the resulting load. The conflict monitor interface circuit 13 will then operate its circuitry to make sure that the conflict monitor receives feedback as to which traffic signal is on and which is off.

FIG. 2 shows a sample embodiment of the power supply 11. It is a switching power supply, having a high power factor, low harmonic distortion and an output regulated at 48 Vdc. When the intersection controller does not activate any output, the amount of power drawn from the main line is very small. The power supply is also fitted with a circuit to control the main voltage at which it turns on. If the line voltage is below a certain point, it is considered that the power supply will not work properly and therefore it is self de-activating. Whenever the main line voltage is high enough, the power supply 11 is allowed to function normally. Protection from transitory voltage spikes is provided by metal oxide varistors. A fuse provides over-current protection at the mains line connection.

Figure 3:
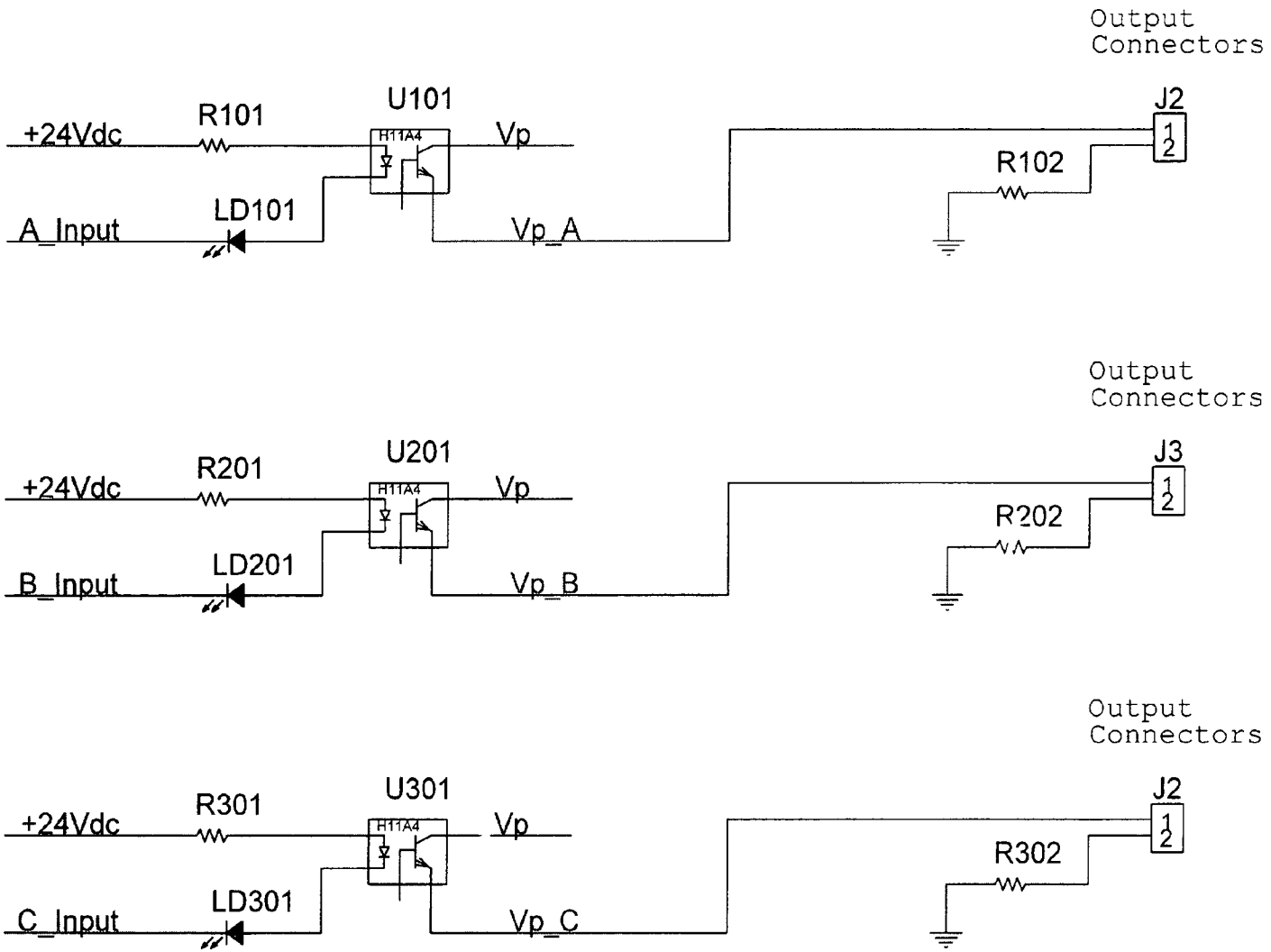
FIG. 3 is an electrical circuit diagram of the output selection circuit.

FIG. 3 shows a sample embodiment of the output selection interface 12. The same circuit is repeated three times, once for each output. Therefore, only one of the three circuits will be explained in detail. In order to preserve isolation between the intersection controller and the load switch 10, an opto-MOS U101 is used. An opto-MOS is an opto-isolator driving a MOSFET all in one package. This enables easy switching of the positive output of the power supply to the selected traffic signal with very low power loss in the switch itself. Resistor R101 is selected to limit the current through the opto-MOS emitter portion. LED LD101 is used to give a visual feedback of the state of the load switch to a person working at the intersection controller cabinet. Resistor R102 is used to sense the current through the traffic signal.

Figure 4:
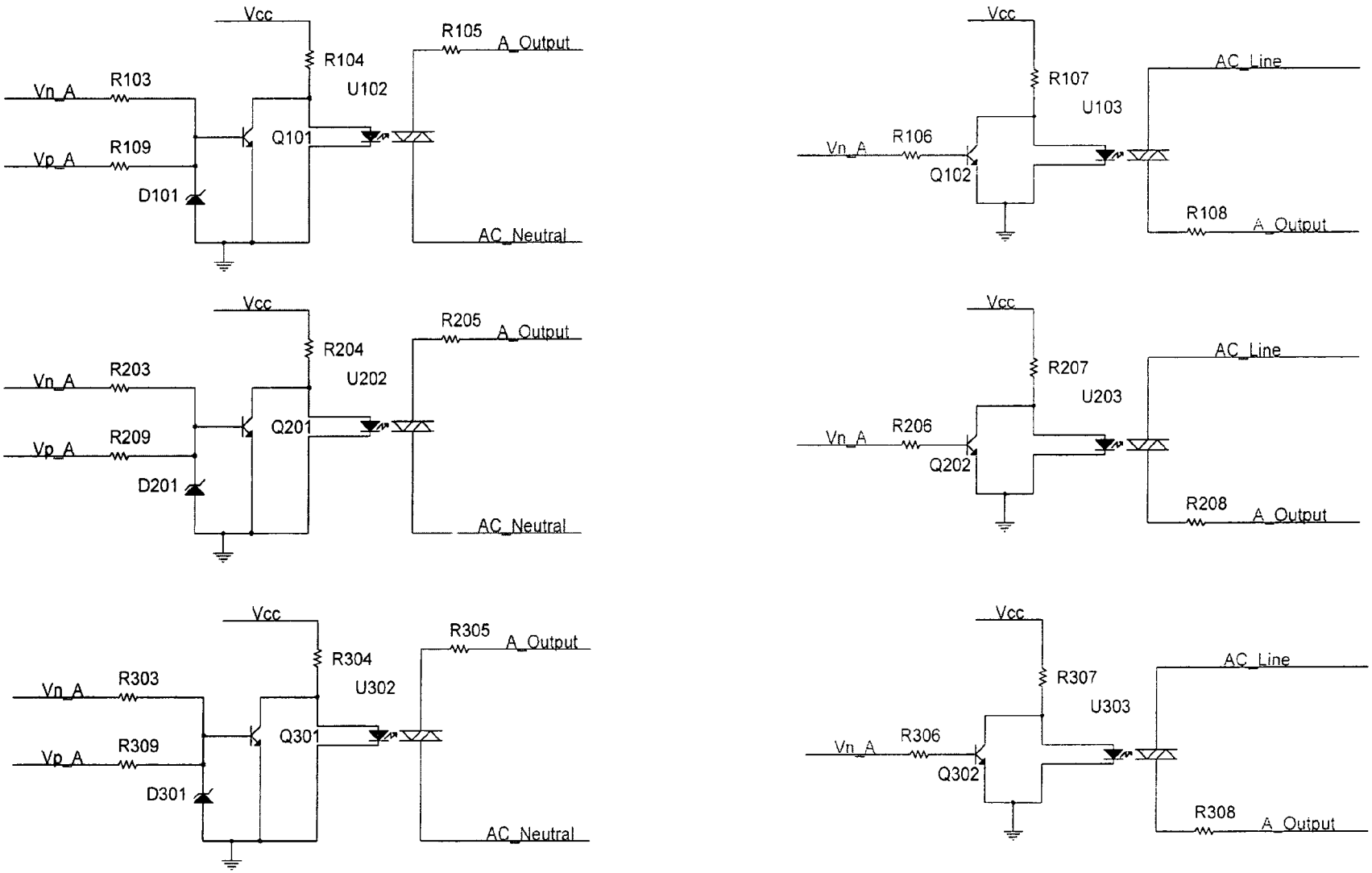
FIG. 4 is an electrical circuit diagram of the conflict monitor interface circuit.

FIG. 4 is a sample embodiment of the conflict monitor interface circuit 13. Here again, the same circuit is repeated three times. The purpose of this circuit is to make the conflict monitor believe that an incandescent bulb is connected to the intersection controller terminals. From an electrical point of view, an incandescent light bulb is a resistor. Therefore, the conflict monitor expects to see more than 80 Vac when a lamp is on and less than 15 Vac when a lamp is off. To mimic this result, resistors are switched from the output terminals to either the live main wire or the neutral main wire.

Figure 5:
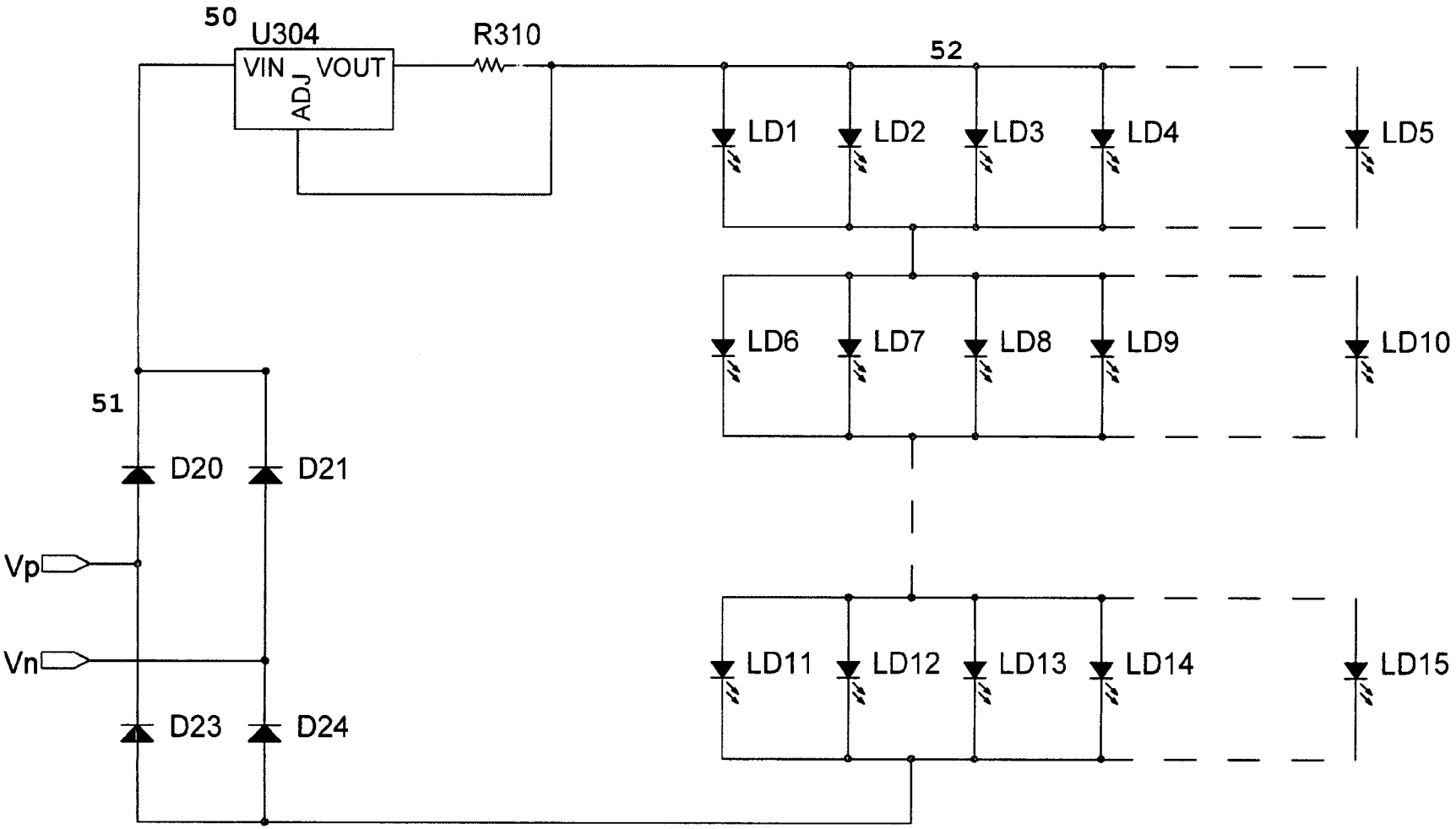
FIG. 5 is an electrical circuit diagram of the traffic signal to be used with the LED traffic signal load switch.

FIG. 5 is a sample embodiment of the traffic signal circuit. Because the power supply 11 generates a 48 Vdc bus, the traffic signal only has to regulate the current through the LEDs. This is accomplished using a current regulator 50, for example, a LM317K. A diode bridge is used at the input of the traffic signal to allow for the possible inversion of the wire coming from the load switch to the traffic signal during installation. The diode bridge will condition the input voltage so that even if the positive output of the power supply 11 is applied to Vn and the negative output power supply 11 is applied to Vp, the traffic signal will still operate. LED array 52 may be composed of at least one chain of at least one LED. The only restriction on the number of LEDs in a chain is that the sum of the forward voltage of the LED(s) of the chain be less than 48V.

The traffic signal circuit may also incorporate light degradation sensing and/or visible fault mode circuits as described in U.S. patent application Ser. No. 10/039,407, "Light Degradation Sensing LED Signal with Visible Fault Mode" filed Jul. 11, 2001, and hereby incorporated by reference in its entirety.

When used as a retrofit to existing intersection controls, the invention only requires that the existing incandescent light bulbs be replaced with suitable LED arrays mounted in housings adapted for placement into the existing signals. The controlling circuitry described herein may be fitted into the existing intersection control cabinet, interconnected via the existing load switch pin-outs and the intersection controller outputs. The existing power supply wires for the original incandescent lights may be used to connect the replacement LED arrays without requiring new wires to be pulled throughout the intersection.

The invention claimed is:

1. A load switch comprising:

a connector;

a single power supply, said power supply is a switching power supply;

an output selection circuit connected to the power supply; and a conflict monitor interface circuit;

wherein said load switch is electrically connected via the output selection circuit to a plurality of LED signals, said plurality of LED signals are powered by said single power supply and said conflict monitor interface circuit includes a plurality of monitoring circuits, each of which monitors one of said plurality of LED signals.

2. The load switch of claim 1 further comprising a control circuit to control a turn-on voltage.

3. The load switch of claim 2 wherein the control circuit deactivates the power supply if a line voltage is below the turn-on voltage.

4. The load switch of claim 2 wherein:

the output selection circuit comprises a plurality of selection circuits and the conflict monitoring interface circuit comprises a plurality of monitoring circuits and there is one selection circuit and one monitoring circuit for each LED signal;

the output selection circuit is activated by an intersection controller and switches an output of the power supply to a selected LED signal; and the monitoring circuits each comprise an output terminal, the output terminal of the monitoring circuit for a selected LED signal connected through a resistor to either a live main wire or to a neutral main wire.

5. The load switch of claim 4 wherein the plurality of LED signals comprise at least one LED signal with a red aspect, at least one LED signal with a green aspect and at least one LED signal with a yellow aspect.

6. The load switch of claim 1 further comprising an electrical circuitry to protect from voltage spikes and electrical circuitry to provide over-current protection.

7. The load switch of claim 6 wherein the electrical circuitry to protect from voltage spikes comprises at least one metal oxide varistor and said circuitry to provide over-current protection comprises at least one fuse.

8. The load switch of claim 1 wherein the output selection circuit comprises a plurality of selection circuits, wherein there is one selection circuit for each of the LED signals.

9. The load switch of claim 8 wherein the plurality of LED signals comprise at least one LED signal with a red aspect, at least one LED signal with a green aspect and at least one LED signal with a yellow aspect.

10. The load switch of claim 8 wherein the output selection circuit is activated by an intersection controller.

11. The load switch of claim 8 wherein the output selection circuit switches an output of the power supply to at least one selected LED signal.

12. The load switch of claim 11 wherein the output selection circuit further comprises a feedback signal.

13. The load switch of claim 12 wherein the feedback signal is at least one LED.

14. The load switch of claim 12 wherein the feedback signal is at least one resistor.

15. The load switch of claim 14 wherein the plurality of LED signals comprise at least one LED signal with a red aspect, at least one LED signal with a green aspect and at least one LED signal with a yellow aspect.

16. The signal of claim 14 wherein the monitoring circuits comprise at least one resistor and an output terminal and said output terminal is connected to either a live main wire to mimic an incandescent lamp in an on-state or to a neutral main wire to mimic an incandescent lamp in an off-state.

17. A system for powering a traffic light, comprising:

a switching power supply that receives power from an external power source and transforms the received power to direct current;

a plurality of LED signals powered by the direct current;

an intersection controller;

an output selection interface that provides power from the power supply to one of the plurality of the LED signals based at least in part upon information received from the intersection controller;

electrical circuitry having at least one metal oxide varistor to protect from voltage spikes; and over-current protection circuitry having at least one fuse to provide over-current protection.

18. A system for operating a bank of lights at an intersection, comprising:

a plurality of LED signals;

an intersection controller;

an output selection interface that provides power from the power supply to one of the plurality of the LED signals based at least in part upon information received from the intersection controller; and a conflict monitor interface circuit that monitors the LED signals to insure only appropriate LEDs have been provided power;

said output selection interface comprises a plurality of selection circuits and said conflict monitoring interface circuit comprises a plurality of monitoring circuits and there is one selection circuit and one monitoring circuit for each LED signal;

said output selection circuit is activated by said intersection controller and switches an output of the power supply to a selected LED signal; and said monitoring circuits each comprise an output terminal, said output terminal of said monitoring circuit for a selected LED signal is connected through a resistor to either a live main or a neutral wire.

* * * * *